United States Patent [19]

Häegele

[11] 4,192,142

[45] Mar. 11, 1980

[54] EXHAUST PIPE AND MOUNTING THEREFOR

[75] Inventor: Gerd Häegele, Winterthur, Switzerland

[73] Assignee: Sulzer Brothers Limited, Winterthur, Switzerland

[21] Appl. No.: 860,964

[22] Filed: Dec. 15, 1977

[30] Foreign Application Priority Data

Dec. 30, 1976 [CH] Switzerland ..... 16460/76

[51] Int. Cl.[2] ..... F01N 7/00

[52] U.S. Cl. ..... 60/322; 60/323; 248/59; 248/70

[58] Field of Search ..... 60/322, 323; 285/62; 248/59, 70, 58, 73, DIG. 1

[56] References Cited

U.S. PATENT DOCUMENTS

| | | | |
|---|---|---|---|
| 2,372,214 | 3/1945 | Loepsinger | 248/59 |
| 2,439,067 | 4/1948 | Wood | 248/58 |
| 2,533,370 | 12/1950 | Haug | 248/73 |
| 2,608,819 | 9/1952 | Moorehead | 60/323 |
| 2,688,501 | 9/1954 | McLeod | 60/322 |
| 3,380,246 | 4/1968 | Dowell | 60/322 |

*Primary Examiner*—Douglas Hart
*Attorney, Agent, or Firm*—Kenyon & Kenyon

[57] ABSTRACT

The exhaust pipe has an axial compensator to compensate for changes in length in the elongated part as well as a pair of props which compensate for changes in length in the bent parts. The props are each articulated to a fixed support point and to the axially elongated part of the pipe. In addition, the props are disposed in different planes relative to each other.

11 Claims, 2 Drawing Figures

EXHAUST PIPE AND MOUNTING THEREFOR

This invention relates to an exhaust pipe and a mounting therefor. More particularly, this invention relates to an exhaust pipe for a reciprocating internal combustion engine.

As is known, the exhaust pipes for reciprocating internal combustion engines generally carry high temperature exhaust gases. As a result, the pipes not only expand considerably but also vibrate considerably as a result of the flow of gases therethrough. Further, exhaust pipes expand not only axially but also in the direction of any bent parts of the pipe. Thus, in some cases, the elongated parts of the pipe have been provided with axial compensators in order to compensate for changes in axial length. However, particular problems arise with very long exhaust pipes which require support over their length since these supports must be able to cope with dimensional changes in two directions.

Accordingly, it is an object of the invention to provide a support for an exhaust pipe which is able to accomodate expansion movements in two or more directions.

It is another object of the invention to provide an exhaust pipe for a recipricating internal combustion engine which is supported for expansion movements in two or more directions.

Briefly, the invention provides an exhaust pipe having an elongated part and a bent part extending from the elongated part, a pair of fixed support points and a pair of props disposed in different planes relative to each other between the support points and one of the pipe parts. The exhaust pipe also has an axial compensator in the elongated part in order to compensate for changes in axial length of the elongated part. In addition, each prop is articulated at one end to a respective support point and at an opposite end to the pipe part.

Advantageously, in order to prevent heat transfer from the exhaust pipe to the support points, the props are articulated to a radial extension of a flange on the pipe part.

In addition, the props are connected to the pipe part, or the radial extension thereof, and to the fixed support point by means of ball joints. In order to permit an adjustment in the lengths of the props, each prop is formed of a pair of elongated components which are disposed in threaded axially adjustable relation to each other.

Figure 1:
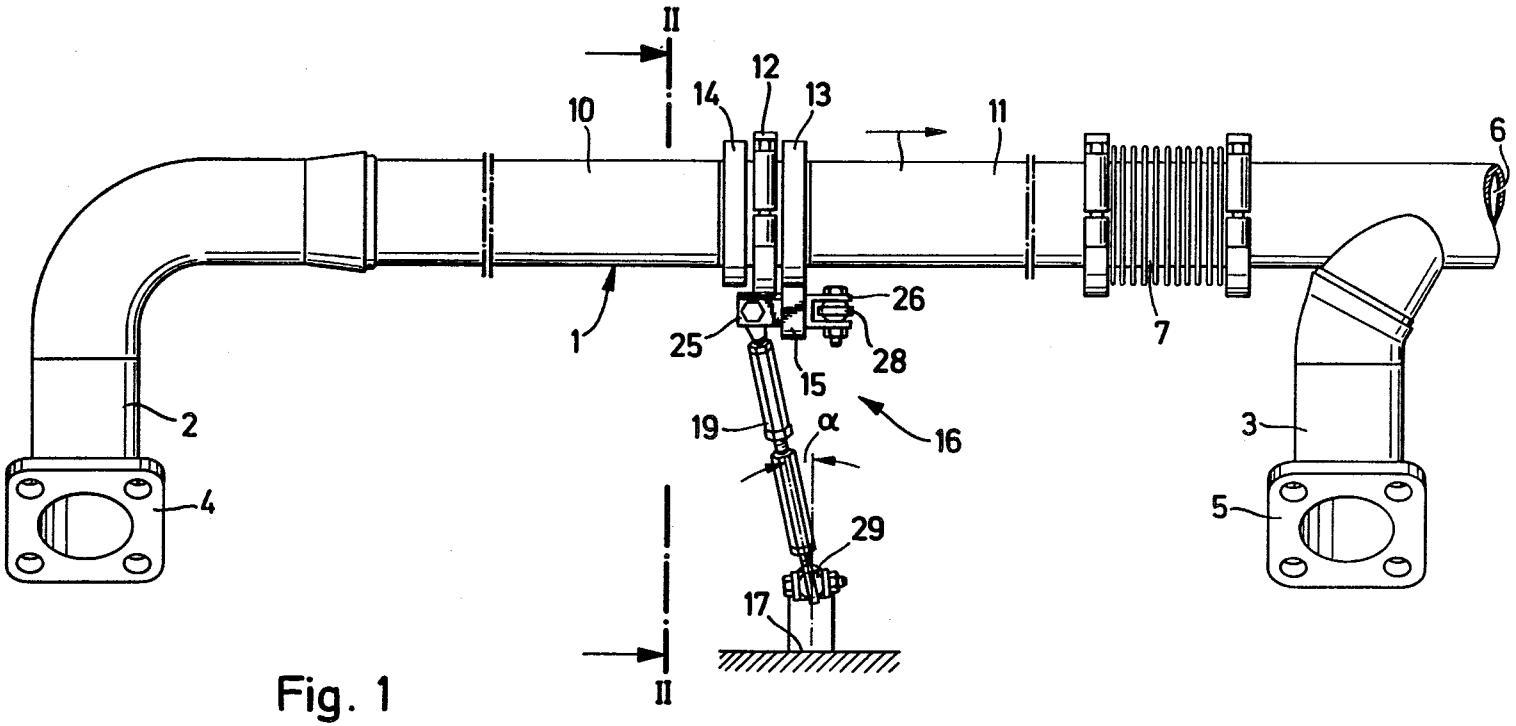
Figure 2:
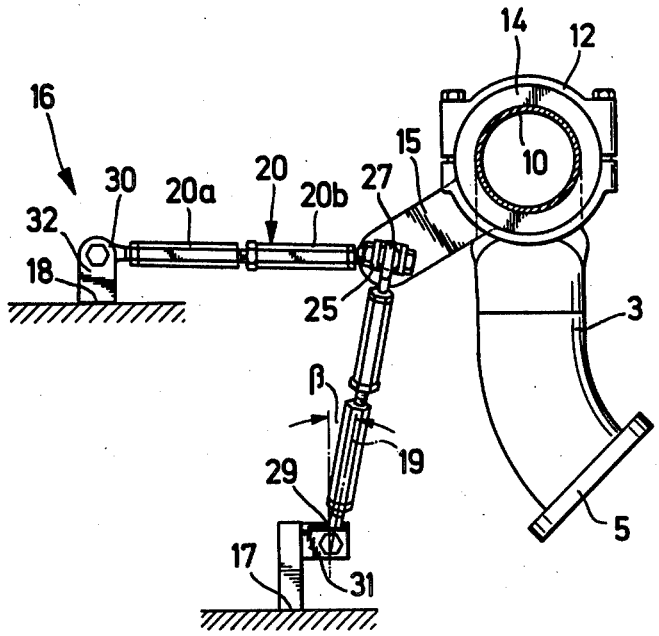

These and other objects and advantages of the invention will become more apparent from the following detailed description taken in conjunction with the accompanying drawings in which:

FIG. 1 illustrates an elevational view of an exhaust pipe mounted in accordance with the invention; and FIG. 2 illustrates a view taken on line II—II of FIG. 1.

Referring to FIG. 1, the exhaust pipe is formed of an elongated part 1 and two bent parts 2,3 which extend from the elongated part 1 at right angles. As shown, each of the bent parts 2,3 is connected by means of flanges 4,5 to a reciprocating internal combustion engine (not shown). The terminal end 6 of the elongated part 1 of the pipe extends, for example to a turbo blower (not shown) of the engine. In addition, the elongated part 1 of the pipe is provided with an axial compensator 7 which compensates for changes in axial length as well as for longitudinal vibrations in the elongated pipe part 1.

As shown, the elongated pipe part 1 is formed of two tubular elements 10, 11 which are connected by means of a pipe coupling 12. The two elements 10, 11 have respective facing flanges 14, 13 with the flange 13 having a radial extension 15 (see FIG. 2).

A support mechanism or device 16 is provided to mount the pipe from two fixed support points 17, 18 of the engine. This support mechanism 16 is formed by a pair of props, or the like, 19,20 which extend between the support points 17, 18 and the radial extension 15. For this purpose, the extension 15 has two forks 25,26 in which the respective prop 19, 20 is articulated, for example by means of a ball joint 27, 28. At the other end, each prop 19,20 is articulated by means of a ball joint 29, 30 in forks 31, 32 disposed at the fixed points 17, 18. As indicated in FIGS. 1 and 2, the two props 19, 20 are disposed in different planes relative to each other between these support points 17, 18 and the elongated part 1 of the pipe. The function of the radial extension 15 is to prevent the high temperature of the pipe from being transferred to the ball joints for the props 19, 20 and as such prevent any possibility of heavy wear of the ball joints.

The fixed point 17 is located relative to the fork 25 so that at ambient temperature, the prop 19 is disposed at an angle $\alpha$ in a counterclockwise direction as viewed in FIG. 1 i.e. the prop 19 is inclined in a direction opposite to the direction of thermal expansion of the pipe elements 10, 11. The exhaust pipe part 1 can therefore move axially as a result of heat expansion and/or vibration. As the pipe part 1 moves, the prop 19 moves through a small arcuate angle. At the same time, the prop 20 moves in a substantially horizontal plane.

At ambient temperature, the prop 20 (FIG. 1) is disposed at a slight angle of deflection in a plane perpendicular to the plane of the drawing i.e. the prop 20 is inclined in a direction opposite to the direction of thermal expansion of the pipe elements 10, 11. When the bent part 2 and/or the bent part 3 expands as a result of being heated, the whole exhaust pipe moves upwards as viewed in FIG. 1.

Referring to FIG. 2, during movement, the props 19, 20 follow the upwards movement of the exhaust pipe by moving counter-clockwise in the plane of a drawing. For example, the prop 19 moves through the angle $\beta$. Consequently, the exhuast pipe can make resultant movements in any direction yet remain completely supported by the engine.

The props 19, 20 are each formed of elongated components which are disposed in threaded axially adjustable relation to each other. As such, the length of each prop can be accurately adjusted. For example, the prop 20 comprises two components 20*a*, 20*b* as shown in FIG. 2.

I claim:

1. In combination an exhaust pipe having an elongated part, a bent part extending from said elongated part and an axial compensator in said elongated part to compensate for changes in axial length of said elongated part;

a pair of fixed support points; and a pair of props disposed in different planes relative to each other between said support points and one of said parts, each said prop being articulated at one end to a respective support point and at an opposite end to said one part and being inclined relative to said elongated part in a direction opposite to the direction of thermal expansion of said elongated part.

2. The combination as set forth in claim 1 which further comprises a flange on said one part and a radial extension on said flange, and wherein said props are articulated to said radial extension.

3. The combination as set forth in claim 2 which further comprises a ball joint at each end of each prop to articulate each prop to said support points and said radial extension.

4. The combination as set forth in claim 3 wherein each prop includes a pair of elongated components disposed in threaded axially adjustable relation to each other.

5. The combination as set forth in claim 1 which further comprises a ball joint at each end of each prop to articulate each prop to said support points and said one part.

6. The combination as set forth in claim 1 wherein each prop includes a pair of elongated components disposed in threaded axially adjustable relation to each other.

7. The combination as set forth in claim 1 wherein said one part is said elongated part.

8. In combination with a reciprocating internal combustion engine, an exhaust pipe having an elongated part, at least one bent part extending from said elongated part to said engine and an axial compensator in said elongated part to compensate for changes in axial length of said elongated part;

a pair of fixed support points; and a pair of props disposed in different planes relative to each other between said support points and one of said parts, each said prop being articulated at one end to a respective support point at an opposite end to said one part and being inclined relative to said elongated part in a direction opposite to the direction of thermal expansion of said elongated part to compensate for changes in axial length of said elongated part and said bent part.

9. The combination as set forth in claim 8 which further comprises a ball joint at each end of each prop to articulate each prop to said support points and said one part.

10. The combination as set forth in claim 9 wherein said one part has a flange and a radial extension on said flange articulated to said props.

11. The combination as set forth in claim 8 wherein said one part is said elongated part.

* * * * *